United States Patent [19]

Johnson

[11] Patent Number: 4,951,818

[45] Date of Patent: Aug. 28, 1990

[54] EQUIPMENT CARRIER AND METHOD OF USING SAME

[76] Inventor: Alan Johnson, 705 Catalina Ave., Seal Beach, Calif. 90740

[21] Appl. No.: 373,349

[22] Filed: Jun. 29, 1989

[51] Int. Cl.[5] ..... A45C 5/14; A45C 13/00; A45C 7/00

[52] U.S. Cl. ..... 206/315.1; 190/18 A; 190/107; 190/127

[58] Field of Search ..... 190/18 A, 107, 127; 206/315.1

[56] References Cited

U.S. PATENT DOCUMENTS

| | | | |
|---|---|---|---|
| 1,601,527 | 9/1926 | Godfrey | 190/127 |
| 4,160,496 | 7/1979 | Knight | 190/107 |
| 4,210,230 | 7/1980 | Weiner | 190/127 X |
| 4,589,530 | 5/1986 | Sher | 190/127 |
| 4,657,135 | 4/1987 | Kjose | 190/18 A |
| 4,756,394 | 7/1988 | Cohen | 190/18 A |
| 4,756,416 | 7/1988 | Johnson | 190/107 X |
| 4,781,278 | 11/1988 | Sadow | 190/107 |
| 4,830,154 | 5/1989 | Gerch et al. | 190/107 X |

FOREIGN PATENT DOCUMENTS

| | | | |
|---|---|---|---|
| 137986 | 11/1947 | Australia | 190/107 |
| 1116141 | 1/1982 | Canada | 206/315.1 |
| 157968 | 10/1985 | European Pat. Off. | 190/18 A |

*Primary Examiner*—William I. Price

*Attorney, Agent, or Firm*—Bernard L. Kleinke; William Patrick Waters; Jerry R. Potts

[57] ABSTRACT

A carrier includes a hollow boxlike body member having a plurality of soft, pliable walls. At least one of the walls contains a compartment of a given width and an impact absorbing panel removably disposed therewithin. The panel has a width somewhat greater than the width of the compartment. The impact absorbing panel is slightly flexed end-to-end about its midplane to tension the compartment to maintain the wall taut in an aesthetically pleasing manner. The panel can be removed from the compartment, to help permit with release of the flexion force, the panel is restored to its usual flat configuration thereby imparting tautness to the compartment. One of the carrier side walls is rigid and has a plurality of wheels fixed to its exterior to rollably support the carrier during transport.

9 Claims, 2 Drawing Sheets

44
44A
38
12
12A
37A
W
37
37B
44B
31
8
76
56
32
10
79
56A
5
5
8A
10A
40
34
9
W
62
36
14A
39
93
52
48
51
43
35
13A
46
11
13
14
41
55
62
9
71
73
73A
69
68
74
74A
67

EQUIPMENT CARRIER AND METHOD OF USING SAME

TECHNICAL FIELD

This invention relates generally to equipment carriers and methods of using same. More particularly, it relates to such carriers and methods for transporting awkward-to-transport sports equipment, such as golf clubs or skis, in a secure and convenient manner.

BACKGROUND ART

It is well recognized that athletes, professional and amateur, frequently travel with their own athletic equipment for purposes of professional appearances and/or recreation. In some cases, where the athletic equipment is small and easily transportable, as for example tennis rackets or ice skates, few significant problems in packaging and transporting the equipment are presented. However, when the athletic equipment is bulky and unwieldy, difficulties arise in safely and securely transporting such items. This is especially true of golf clubs, for example, because the elongated clubs are heavy and are usually transported loosely within a golf bag. The clubs, as well as the golf bag, are generally quite expensive, and thus it is desirable to provide for protection of such equipment during shipment thereof, by a common carrier, such as an airline or bus line. In addition, the golf clubs, known as "woods," have highly polished hardwood heads, which can be easily damaged or scuffed during transportation. Further, the golf clubs are usually transported within the golf bag with the club shafts disposed within the bag and the highly polished heads either maintained in an exposed condition or covered by a light covering. In either position, the heads are not adequately protected against unwanted inadvertent damages resulting from rough handling by common carrier personnel during shipment thereof.

Further, in light of the bulkiness and size of the golf clubs/golf bag combination, it is not readily adapted to be brought aboard public conveyances, such as airplanes, where the owner would be able to exercise caution during transportation. Instead, the bag of clubs is generally placed in the aircraft's luggage compartment, together with other items of luggage, thereby exposing the bag and clubs to a risk of damage. This risk is sometimes graphically evident at the end of an airplane trip, when pieces of luggage, of diverse sizes and mass, are unloaded into a chute and allowed to tumble onto a carousel in an uncontrolled manner.

Even though some golf bags have hoods to cover the clubs, thereby affording a small degree of protection, transporting the golf bag in an exposed manner frequently entails serious risk of damage to the clubs, as well as to the bag itself. Another consideration is an increased possibility of theft, when the exposed golf bag is transported, because the golf bag is easily recognizable and readily carried away by a thief.

In light of the foregoing problems, certain devices have been utilized for the transportation of athletic equipment, such as golf clubs. One such device is a bag, usually of canvas or similar material, which is closed about the golf bag and clubs. While such a device provides limited protection by avoiding easy identification of its contents by a potential thief, such bags due to their soft-sided construction, do not afford adequate protection from the type of damage caused by contact with sharp objects or impacts from heavy objects or rough handling. Of course, impact damage and penetration by sharp objects are not uncommon problems when equipment is shipped on commercial carriers. In addition, such bags are not readily adapted for long, relatively heavy golf clubs to be carried manually in a convenient manner through crowded airports and terminals. Further, such soft sided bags are generally shapeless and unattractive in appearance, and thus are not generally compatible with the expensive and aesthetically pleasing appearance of modern golfing equipment and skis. In view of the limitations of soft sided carriers, it would be desirable to have a carrier for transporting equipment, such as a golf bag containing clubs, which would provide safety and security for the contents thereof. Also, such a carrier should provide significant impact and penetration resistance and convenience during transportation thereof.

In some cases, to avoid the limitations of soft sided bags, cartons, typically being constructed of paperboard, have been utilized to transport combinations of golf bags and clubs. While the paperboard carton avoids some of the disadvantages of the soft sided bag, it still falls short of providing a secure and convenient transportable device. For one thing, paperboard cartons afford less than adequate protection against damage from severe impacts or sharp penetrating blows, since the paperboard material can be cut open or crushed as a result of rough handling thereof Further, because they are not conveniently stored and are frequently damaged during a single trip, they are generally not reusable. Also, paperboard cartons are not adapted to be transported manually in a convenient manner through an airport terminal, due to their bulky and unwieldy nature. Finally, cartons of this type provide little or no protection of their contents from wet weather conditions, such as rain. Moreover, the cartons have an unattractive appearance, and certainly are not intended to be of the same quality and character as modern expensive luggage.

Therefore, it would be highly desirable to have a carrier which provides both security and protection for its contents, and which would be convenient to transport manually by its owner through crowded airport terminals. Such a carrier should be able to be stored in a convenient manner when not in use.

DISCLOSURE OF INVENTION

Therefore, it is the principal object of this invention to provide a new and improved carrier and a method of using it, for transporting securely and conveniently equipment, such as a golf bag containing golf clubs.

It is a further object of this invention to provide such a carrier and method of using it, wherein the carrier is aesthetically pleasing in appearance and can be stored in a convenient manner when not in use.

It is still a further object of this invention to provide such a carrier and method of use, wherein the construction of such a carrier affords impact and penetration resistance for its contents.

Briefly, the above and further objects of the present invention are realized by providing an equipment carrier, and a method of using it, wherein bulky equipment, such as a combination of golf clubs and a golf bag may be handled conveniently during transportation and stored conveniently when not in use.

A carrier includes a hollow boxlike body member having a plurality of soft, pliable walls. At least one of the walls contains a compartment of a given width and an impact absorbing panel removably disposed therewithin. The panel has a width somewhat greater than the width of the compartment. The impact absorbing panel is slightly flexed end-to-end about its midplane to tension the compartment to maintain the soft, pliable wall taut in an aesthetically pleasing manner. The panel can be removed from the compartment, to help permit the body member to collapse when not in use, for storage purposes.

The boxlike body member may be sized to receive conventional golf club/bag combination. The tensioned flexible, impact absorbing panel provides stability and strength to the carrier and serves to help protect its contents from impact or penetration damage by distributing forces over the surface of the panel. Because of the tautness so imparted, inadvertent blows to the carrier or other material contact with sharp objects, which would otherwise damage the contents of a flexible bag or paperboard carton, do not tend to damage the contents of the inventive carrier.

In addition to the protective advantages afforded by the present invention, during transportation, such as through an airport terminal, the carrier can be rolled on a set of wheels extending from a rigid side wall thereof. A leash or strap may be attached in a convenient manner to the carrier in order to facilitate pulling it manually rollably along the ground.

Further, the walls of the carrier can be made from a suitable waterproof material to protect the contents of the carrier from wet weather conditions.

BRIEF DESCRIPTION OF DRAWINGS

The above mentioned and other objects and features of this invention and the manner of attaining them will become apparent, and the invention itself will be best understood by reference to the following description of the invention in conjunction with the accompanying drawings, wherein.

BEST MODE FOR CARRYING OUT THE INVENTION

Figure 1:
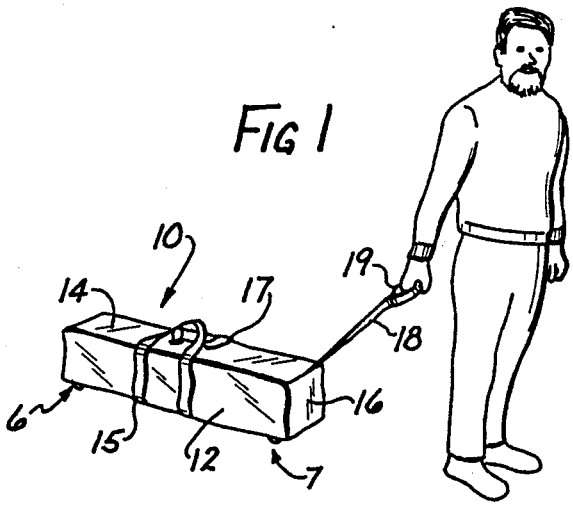
FIG. 1 is a pictorial view of an equipment carrier, which is constructed according to the present invention, and which is shown being pulled rollably along the ground.
Figure 2:
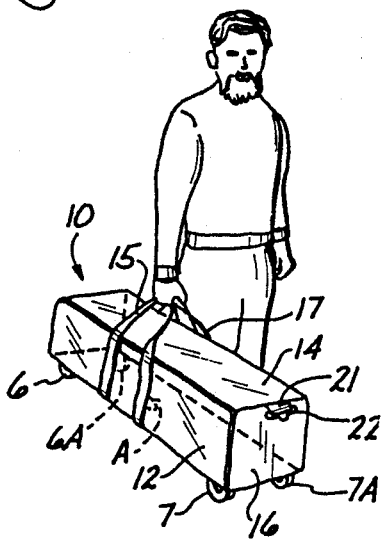
FIG. 2 is a slightly enlarged, pictorial view of the carrier of FIG. 1, illustrating it being carried manually.
Figure 3:
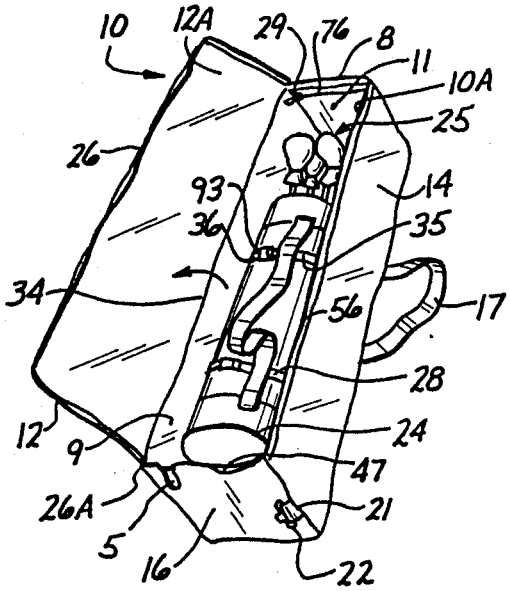
FIG. 3 is an enlarged pictorial view of the carrier of FIG. 1, illustrating it in an opened position to expose its contents to view.

Referring now to the drawings, and more particularly to FIG. 1, 2 and 3, thereof, there is shown a carrier 10, which is constructed in accordance with the present invention, and which is adapted to receive and support equipment, such as a golf bag 24 containing a set of golf clubs 25. While the carrier 10 is shown and described to be used for athletic equipment, such as golf clubs or skis, it should be understood that the carrier of the present invention, may well be used for carrying other types and kinds of equipment as well. For example, the inventive carrier may also be used for other equipment, such as wearing apparel, or any other equipment or items, desired to be placed within the carrier.

Figures 4, 5:
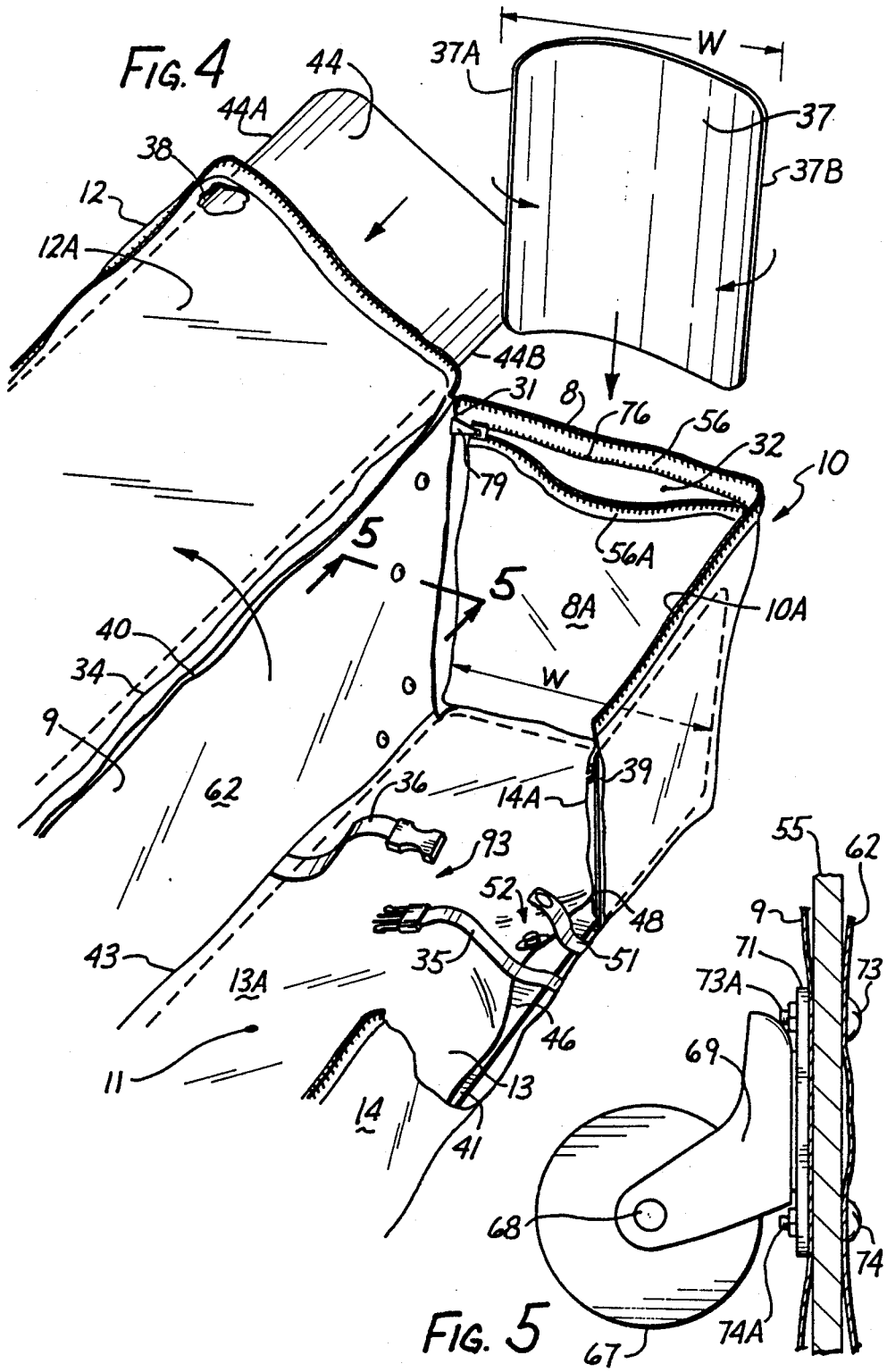
FIG. 4 is a greatly enlarged, fragmentary, pictorial view of the carrier of FIG. 1, illustrating it in the process of it being assembled in preparation for receiving its contents.
FIG. 5 is a greatly enlarged sectional view of the carrier of FIG. 4 taken substantially on line 5—5 thereof.

As shown in FIG. 3 and 4, the carrier 10 has a hollow, elongated boxlike configuration with an openable top wall 12, a right side wall 9, a left side wall 14, a front end wall 16 (FIG. 3), a rear end wall 8 (FIG. 4), and a bottom wall 13 (FIG. 4). As shown in FIGS. 1, 2 and 5, a set of five wheel assemblies, such as wheel assembly 6 and 7, are fixedly attached to the exterior surface of the right side wall 9 to support rollably the carrier along the ground.

As shown in FIGS. 3 and 4, the top wall 12 is of a flaplike construction and can be opened to introduce the contents to the hollow interior of the carrier 10. When the top wall 12 is moved to its closed position to close off the hollow interior, the carrier 10 is then positioned on its right side wall 9 with the wheel assemblies, which can then support the carrier 10 rollably on the ground as shown in FIG. 1, or which can be carried manually by a pair of carrying straps or handles 15 and 17 extending adjacent to the right side wall as shown in FIG. 2.

Therefore, it should now be apparent that there are two different orientations of the carrier 10. As shown in FIGS. 1 and 2, the orientation of the right side wall 14 being disposed upwardly, is employed during the transporting of the carrier 10. As shown in FIGS. 3 and 4, the orientation of the top wall 12 being disposed upwardly, is assumed to facilitate loading and unloading the carrier 10.

According to the method of the present invention, by utilizing the loading and unloading position of FIGS. 3 and 4, the wheel assemblies project sidewardly from the right side wall 9, and thus the assemblies do not come into contact with the supporting surface, since the carrier 10, in its loading orientation, rests on its bottom wall 13. Therefore, heavy, bulky equipment, such as the golf bag containing the golf clubs, can be lowered into the opened carrier, without inadvertently having the carrier 10 roll along the ground away from the user. Once the carrier 10 is loaded or unloaded, it can be carried conveniently by the handles 15 and 17 (FIG. 2), or can be pulled rollably on the wheel assemblies by a strap or leash 18 having a bight or handle portion 19 (FIG. 1).

As indicated in FIG. 2 of the drawings, the carrier 10 has five wheel assemblies. Wheel 6 and 6A are located at: the rear corners, and assemblies 7 and 7A are disposed at the front corners, of the side wall 9. A fifth wheel assembly A is located near the center of right side wall 9 to help provide support to the central portion of carrier 10 during transportation. The carrier 10 rests on the bottom wall 13 during the placing and removal of the golf bag and clubs into and out of the interior of the carrier 10. Thus, the heavy equipment can be placed within the carrier with no danger of its inadvertent changing of its position during loading or unloading.

One end of the a leash 18, having the bight 19 at its opposite free end, is attached removably to the front of the carrier 10 to enable a user holding the bight 19 to pull the carrier 10 rollably along a surface (FIG. 1). The carrying straps 15 and 17 are fixed, respectively to the top wall 12 and the bottom wall 13, enable the user to support the loaded carrier 10 therefrom (FIG. 2).

A tab 21 extends from the juncture of the front wall 16 and the left side wall 14 having a conventional first connector portion 22 adapted to mate with a conventional receiving portion (not shown) on the leash 18, to permit easy attachment and removal of the leash 18.

Referring now to FIG. 3, two pairs of adjustable tie down straps 28 and 35, are affixed at the interior 11 of the carrier 10 to wrap around the golf bag 24, and secure it releasably to the bottom wall 13.

Considering now the carrier 10 in greater detail, with reference to FIGS. 1, 2 and 3, the top wall 12 is hingedly attached along a longitudinally extending integral spine 34 along one of its sides to the top of the right side wall 9 so as to move toward and away from an opened rectangular mouth 10A of the carrier 10 formed by the edges of the walls 8, 14 and 16, as well as the spine 34, to allow ready access to the hollow interior 11. A closure device 26 attaches releasably to three free edges of the top wall 12 to the top edges of the walls 8, 14 and 16.

The side walls 9 and 14, the top wall 12, the front wall 16 and the rear wall 8 are constructed of a soft, pliable waterproof unwoven fabric material. Each wall has a corresponding, overlying flexible, inner liner such as right and left side wall liners 9A and 14A, respectively, a top wall liner 12A, a right side wall liner 62, and a rear end wall liner 8A. The front end wall 16 has a similar, corresponding inner liner (not shown). The right side wall liner 62 and the top wall liner 12A are sewn together at the spine or seam 34.

Each inner liner is joined to its respective exterior liner by stitching, such as the stitching 31, along three of its edges to define a compartment, such as the compartment 32 formed in the end wall 8 (FIG. 4). Similarly formed respective compartments 39 and 41, in the left side wall 14 and the bottom wall 13 are depicted in FIG. 4. Similarly formed compartments 38 and 47 are disposed individually within the top wall 12, and the front wall 16 (FIG. 3), respectively.

As shown in FIGS. 3 and 4, the compartments 32, 39 and 47 have a common, continuous upper edge or lip portion 56 for defining the upper margins of the three compartments. A closure member in the form of a slide fastener 76 extends along the lip 56 closes releasably all three compartments simultaneously as shown in FIG. 3, and opens them as shown in FIG. 4. The lip portion 56 define the openings in the compartments 32, 39 and 47.

In order to provide impact resistance to the carrier 10, individual complementary-shaped impact absorbing panels are located within each one of the compartments. As shown in FIG. 4, each impact absorbing panel, is similar to one another, and a panel 37 will now be described in greater detail The rear end panel 37 is generally rectangular in shape, and is composed of thin, flexible material to provide resilient to impacts and inadvertent penetration. The panel 37 is composed of suitable thermoplastic material The panel 37 has a width W in its unstressed condition, measured between panel side edges 37A and 37B, dimensioned to be slightly greater than the corresponding width W of the rear end compartment 32. In general, the size and shape of the panel 37 is similar to the size and shape of the compartment 32. Prior to its insertion into the compartment 32, the panel 37 is flexed manually so as to draw the edges 37A and 37B together about the midplane M of the panel 37. While flexed, the panel 37 is inserted completely into the compartment 32. With release of the panel 37, the panel tends to resume its normally flat configuration, to tension the end wall 8, and providing impact absorbing and penetration resistance characteristics thereto. With the panel 37 completely disposed within the compartment 32, the slide fastener 76 is then closed to retain the flexed panel securely within the compartment 32.

A similarly dimensioned impact absorbing front panel 47 is utilized in the front wall compartment 47 (FIG. 3) to serve the same function as that of the rear impact absorbing panel 37.

As shown in FIG. 4, an elongated impact absorbing panel 44 serves the same function as the panel 37 for the top wall 12, and is disposed within the complementary size compartment 38.

A similar impact absorbing panel 48, similar in dimensions and function to the top impact absorbing panel 44, is disposed within the complementary sized and shaped compartment 39, to serve a similar function as the panel 37.

In order to tension the bottom wall 13, an impact absorbing panel 46, also similar in dimensions and function to the top panel 44, is disposed within the complementary sized and shaped bottom wall compartment 41. The compartment 41 is formed between the bottom wall 13 and an inner liner 13A which is stitched to the bottom wall 13 by stitching 43. The remaining three edges of the bottom liner 13A are free to permit clearance for the panel 46 during its insertion and removal into and out of the bottom compartment 41.

As shown in FIG. 4, a pair of tabs, such as a tab 51 having a snap fastening device 52 serves to close releasably the compartment 41.

Except for the right side wall 14 of the carrier 10, each one of the impact absorbing panels has an unstressed width, which is slightly wider than the width of its complementary sized and shaped compartment, so that each panel can be bowed about its midplane to stress it, thereby tensioning its compartment to provide a smooth aesthetically pleasing appearance. In general, it will now become apparent that each wall, such as the rear end wall 8, is composed of soft, pliable unwoven fabric material. The wall helps define a panel receiving compartment, such as a compartment 32, with an inner liner, such as the liner 8A and a closure member, such as the slide fastener 76. The panels provide the carrier 10 with a lightweight construction and with superior impact absorbing and penetration resistance characteristics, thereby affording security to the contents of the carrier 10.

The process of insertion of the impact panels into their respective compartments can be easily reversed to remove them conveniently. After the panels have been removed, the carrier 10 can be collapsed for convenient storage purposes. The panels are stored inside the collapsed interior of the carrier 10.

With regard now to the right side wall 9, with reference to FIGS. 4 and 5, the wall is constructed rigidly, and has a rigid rectangularly shaped panel 55 which is disposed within the compartment 41 (FIG. 4), defined by the outer wall 9 and inner liner 62. While a variety of materials are suitable for the rigid panel 55, $\frac{1}{4}''$ to $\frac{3}{8}''$ plywood material is preferred. In this regard, the rigid panel is sufficiently thick to provide adequate support for the contents of the carrier 10. Also, the rigid panel 55 serves as a suitable backing member for the wheel assemblies attached to it. Each one of the wheel assemblies is similar to one another, and thus only the assembly 6 will now be described. The assembly 6 includes a roller 67 journalled for rotation about an axle 68 supported by a yoke or bracket 69. The bracket 69 is, in turn, swivelly attached to a base 71 for 360° movement thereout. The base 71 is fixed to the right side wall 9 and its rigid backing panel 55, by fastening devices such as bolts 73 and 74, which are engaged respectively by nuts 73A and 74A.

Two pairs of straps, such as straps 35 and 36 fixed at the interior of the carrier 10 are adapted to fit about the golf bag 13 to secure it to the bottom wall 13. A two part fastening device, such as the buckle device generally indicated at 93 releasably connect the free ends of the straps 35 and 36 to fix them about the bag 13. The straps may be adjustable in length so as to accommodate varying sized contents within the carrier 10.

While a particular embodiment of the present invention has been disclosed, it is to be understood that various different modifications are possible and are contemplated within the true spirit and scope of the appended claims. There is no intention, therefore, of limitations to the exact abstract or disclosure herein presented.

What is claimed is:

1. A carrier comprising:

a body member having end, side, top and bottom walls for defining a long, narrow hollow interior which is adapted to receive equipment, said member being boxlike in configuration and having a plurality of soft, pliable walls; said side, top and bottom walls being substantially longer in their respective widths relative to the widths of the end walls to enable the body member to receive and to store long, narrow athletic equipment, such as skis;

wheel means for supporting the carrier rollably along a supporting surface;

one of said walls including a long narrow compartment;

a single rigid panel for rigidifying said one of said walls and supporting said equipment, said panel being disposed within said long narrow compartment;

fastening means for affixing to the exterior of said one of said walls said wheel means, said fastening means extending through a portion of said long narrow compartment and through said rigid panel;

each one of the other walls having means defining a compartment therewithin, each one of said compartments having a given dimension and having closure means for closing the respective compartments;

each one of said compartments extending over substantially the entire interior surface area of its corresponding wall;

a plurality of impact absorbing panels, for distributing forces exerted against the exterior of said walls over the surface of at least one of said panels;

each one of said panels being disposed within a corresponding compartment;

said compartment having a dimension somewhat less than the given dimension of said corresponding panel;

each one of said panels being flexible end-to-end about its midplane extending transversely of the given dimension for permitting said panels to be received within each of their corresponding compartments; and each one of said panels being flexed about its midplane within the interior of its compartment for impact absorbing purposes and for tensioning said compartment to cause its corresponding wall to be maintained in a taut tensioned aesthetically pleasing manner.

2. A carrier of claim 1, wherein said fastening means includes a plurality of nuts and bolts.

3. A carrier of claim 2, wherein said long narrow compartment extends over substantially the entire interior area of said one of said walls.

4. A carrier of claim 3, wherein said rigid panel extends the length of the carrier, and is dimensioned and complementarily shaped to said compartment.

5. A carrier of claim 1, wherein each one of said impact absorbing panels is composed of a flexible rigid material.

6. A carrier of claim 3, wherein each one of said impact absorbing panels is generally rectangular in configuration, and is thin in cross section.

7. A carrier of claim 1, wherein each one of said impact absorbing panels is disposed removably within its corresponding compartment.

8. A carrier of claim 1, wherein the dimension of said compartments having impact absorbing panels individually disposed therewithin is a width dimension.

9. A carrier of claim 8, wherein the dimension of each one of said flexible panels is a width dimension.

* * * * *